US011180922B2

(12) United States Patent
Maziarz

(10) Patent No.: US 11,180,922 B2
(45) Date of Patent: Nov. 23, 2021

(54) BEAD STOP FOR A WALL HAVING IN INTERIOR CEMENT BOARD LAYER

(71) Applicant: E-Z BEAD, LLC, Royersford, PA (US)

(72) Inventor: Jeffrey Maziarz, Royersford, PA (US)

(73) Assignee: E-Z BEAD, LLC, Royersford, PA (US)

( * ) Notice: Subject to any disclaimer, the term of this patent is extended or adjusted under 35 U.S.C. 154(b) by 0 days.

(21) Appl. No.: 16/751,006

(22) Filed: Jan. 23, 2020

(65) Prior Publication Data

US 2021/0180335 A1 Jun. 17, 2021

Related U.S. Application Data

(60) Provisional application No. 62/947,885, filed on Dec. 13, 2019.

(51) Int. Cl.
*E04F 19/02* (2006.01)
*E04C 2/04* (2006.01)

(52) U.S. Cl.
CPC ..... *E04F 19/02* (2013.01); *E04C 2/044* (2013.01)

(58) Field of Classification Search
CPC ..... E04F 13/09; E04F 2013/065; E04F 13/06; E04F 13/068; E04C 2/044; E04B 1/765
See application file for complete search history.

(56) References Cited

U.S. PATENT DOCUMENTS 517,701 A 4/1894 Knower
1,030,044 A 6/1912 Whittbecker
1,361,843 A 12/1920 Flagge
1,386,509 A 8/1921 Kirmes
1,673,971 A 6/1928 Dowell
1,679,914 A 8/1928 Murray
1,840,221 A 1/1932 Bridges
1,886,320 A 11/1932 Waite
1,956,809 A 5/1934 Robertson
2,031,249 A 2/1936 Bowman
2,151,605 A 3/1939 Lavering
2,189,216 A 2/1940 Mathias
2,198,084 A 4/1940 Jacobson
(Continued)

FOREIGN PATENT DOCUMENTS

DE 2455775 8/1976 ..... E04F 15/14
DE 2538412 3/1977 ..... E04F 15/14
(Continued)

OTHER PUBLICATIONS

Office Action issued in Canadian application No. 2,983,532 dated Aug. 25, 2020 (3 pgs).
(Continued)

*Primary Examiner* — Theodore V Adamos
(74) *Attorney, Agent, or Firm* — Hayes Soloway P.C.

(57) ABSTRACT

Methods, systems, and an apparatus for constructing a termination point in a wall are provided. A stop bead apparatus is attached to exterior sheathing of the wall at a terminating location of the wall. An edge of a rigid, cured cement board is inserted into a gap formed between a base panel and a front wall of the stop bead apparatus. The cement board is secured to the exterior sheathing, wherein at least a portion of the base panel of the stop bead apparatus is positioned between the exterior sheathing and the cement board. A finish layer is applied to an exterior surface of the cement board.

18 Claims, 9 Drawing Sheets

(56) References Cited

U.S. PATENT DOCUMENTS 2,272,162 A 2/1942 Lackey
2,286,890 A 6/1942 Birt
2,405,844 A 8/1946 Mortenson
2,645,824 A 7/1953 Titsworth ..... E04B 1/7069
2,725,608 A 12/1955 Parslow
2,732,045 A 1/1956 Herlocker
2,742,120 A 4/1956 Rosebrook
2,845,666 A 8/1958 Knapp
RE24,658 E 6/1959 Hollister
2,904,992 A 9/1959 Cruser
2,953,835 A 9/1960 Armstrong
3,192,577 A 7/1965 Barr
3,201,908 A 8/1965 Arnold
3,213,577 A 10/1965 Levin
3,314,201 A 4/1967 Riegelman
3,319,384 A 5/1967 Berg
3,320,707 A 5/1967 Berg ..... E04D 3/366
3,343,323 A 9/1967 Mayfield ..... 545/254
3,344,720 A 10/1967 Hallock ..... E01D 19/06
3,349,519 A 10/1967 Nehlig
3,398,494 A 8/1968 Larson
3,421,267 A 1/1969 Reiff ..... E04D 13/1415
3,425,172 A 2/1969 Attaway ..... E04D 13/1415
3,486,283 A 12/1969 Arnett
3,509,674 A 5/1970 Birum, Jr.
3,512,318 A 5/1970 Turner
3,608,254 A 9/1971 Sklamberg
3,619,944 A 11/1971 Matvey
3,638,372 A 2/1972 Rosenthal ..... 52/97
3,667,174 A 6/1972 Arnett
3,670,470 A 6/1972 Thom ..... E04D 13/151
3,765,138 A 10/1973 Bentle
3,782,680 A 1/1974 Hopkins
3,813,180 A 5/1974 O'Brill
3,849,958 A 11/1974 Balzer ..... E04B 1/6804
3,871,787 A 3/1975 Stegmeier
3,922,826 A 12/1975 Molyneux
3,964,220 A 6/1976 Rutkowski
3,974,609 A 8/1976 Attaway ..... E04B 1/6804
4,038,791 A 8/1977 Atkinson
4,111,583 A 9/1978 Brady ..... E01D 19/06
4,271,650 A 6/1981 Lynn-Jones ..... E04B 1/6804
4,295,315 A 10/1981 Lynn-Jones ..... E04B 1/6804
4,359,847 A 11/1982 Schukolinski ..... E04B 1/6804
4,505,079 A 3/1985 Black
4,545,162 A 10/1985 Attaway
4,651,488 A 3/1987 Nicholas
4,663,883 A 5/1987 Hilliard
4,726,148 A 2/1988 Tix
4,763,455 A 8/1988 Schneller
4,774,795 A 10/1988 Braun
4,781,004 A 11/1988 Hartman
4,784,516 A 11/1988 Cox
4,785,601 A 11/1988 Tupman
4,829,731 A 5/1989 Schluter
4,833,851 A 5/1989 Ohmatsu ..... E04B 1/6804
4,841,704 A 6/1989 Jarrell
4,984,402 A 1/1991 Davies ..... 52/398
5,014,471 A 5/1991 Ballstadt
5,042,211 A 8/1991 Nestler
5,073,430 A 12/1991 Aidan
5,127,204 A 7/1992 Braun
5,181,357 A 1/1993 Pourtau
5,210,986 A 5/1993 Hagemeyer
5,222,343 A 6/1993 Anderson
5,230,738 A 7/1993 Wheeler
5,305,566 A 4/1994 Larkowski
5,313,755 A 5/1994 Koenig, Jr.
5,333,432 A 8/1994 Schluter
5,338,130 A 8/1994 Baerveldt
5,365,713 A 11/1994 Nicholas ..... E04B 1/681
5,384,996 A 1/1995 Nicholas ..... E04B 1/681
5,406,758 A 4/1995 Baum ..... 249/6
5,423,154 A 6/1995 Maylon
5,430,981 A 7/1995 Scott
5,450,699 A 9/1995 Lee
D364,233 S 11/1995 Caley
5,519,969 A 5/1996 Golba ..... 52/60
5,544,445 A 8/1996 Mantilla
5,551,201 A 9/1996 Anderson
5,560,166 A 10/1996 Burke ..... F16J 15/065
5,575,126 A 11/1996 Attaway ..... E04B 1/6804
5,579,623 A 12/1996 Stark
5,607,253 A 3/1997 Almstrom
5,671,571 A 9/1997 Braun
5,694,723 A 12/1997 Parker ..... E02D 27/32
5,699,638 A 12/1997 Maylon
5,761,866 A 6/1998 Maylon
5,790,671 A 8/1998 Cooper
5,791,111 A 8/1998 Beenders ..... E04B 1/6804
5,791,116 A 8/1998 Skintzis
5,836,135 A 11/1998 Hagan ..... E04B 1/762
5,937,600 A * 8/1999 Larson ..... E04B 1/762
52/302.6
5,946,870 A 9/1999 Bifano et al. ..... 52/254
5,950,370 A 9/1999 Peck
5,970,671 A * 10/1999 Bifano ..... E04B 1/765
428/603
6,018,924 A 2/2000 Tamlyn
6,052,959 A 4/2000 LaBrosse ..... E04B 1/7076
6,102,407 A 8/2000 Moriya et al.
6,119,416 A 9/2000 Larson
6,122,883 A 9/2000 Braun
6,131,352 A 10/2000 Barnes ..... E04B 1/948
6,223,486 B1 5/2001 Dunham
6,293,064 B1 * 9/2001 Larson ..... E04B 1/762
52/209
6,298,609 B1 * 10/2001 Bifano ..... E04B 1/765
52/101
6,308,475 B1 10/2001 Crish, II
6,322,045 B1 11/2001 Andros
6,338,229 B1 1/2002 Botzen
D456,528 S 4/2002 Maylon
6,367,210 B1 4/2002 Trundle
6,385,932 B1 5/2002 Melchiori ..... 52/302.3
6,410,118 B1 * 6/2002 Reicherts ..... B32B 13/04
428/141
6,425,216 B1 7/2002 Gardner
6,470,638 B1 * 10/2002 Larson ..... E04B 1/765
52/254
6,490,831 B1 12/2002 Candusso
D471,991 S 3/2003 Maylon
6,527,467 B2 3/2003 Betts ..... E01D 19/065
6,598,360 B1 7/2003 Pratt ..... E02D 31/02
6,609,341 B2 8/2003 Maylon et al. ..... 52/367
6,631,595 B1 10/2003 Minter
6,698,144 B1 * 3/2004 Larson ..... E04B 1/765
52/202
6,705,047 B2 3/2004 Yulkowski
6,745,531 B1 * 6/2004 Egan ..... E04B 1/70
52/302.1
7,406,805 B1 8/2008 Larson
7,458,190 B2 12/2008 Isaac et al.
7,526,897 B2 5/2009 Collins
7,634,883 B1 12/2009 Larson
7,673,421 B2 3/2010 Pilz ..... E04D 1/36
7,874,123 B2 1/2011 Maziarz
8,132,380 B2 3/2012 Wilkes, Jr.
8,561,367 B2 10/2013 Kelly ..... E04D 3/405
8,578,660 B2 11/2013 Nolan et al. ..... 52/62
8,615,944 B2 12/2013 Maziarz
8,646,235 B2 2/2014 Hilburn ..... E04B 1/948
8,919,062 B1 12/2014 Viness et al. ..... 52/302.3
9,062,453 B1 6/2015 Maziarz ..... E04B 1/68
9,238,897 B2 1/2016 Nolan et al. ..... E02D 31/02
9,279,247 B2 3/2016 Maziarz ..... E04F 1/66
D762,310 S 7/2016 Apanovich ..... D25/119
9,797,142 B1 10/2017 Sacks ..... E04F 13/04
10,196,812 B1 2/2019 Duffy et al.
10,358,814 B2 7/2019 Maziarz ..... E04F 13/04
10,494,818 B2 12/2019 Maziarz ..... E04F 13/04
10,648,184 B2 * 5/2020 Maziarz ..... E04F 19/06
11,091,921 B2 * 8/2021 Maziarz ..... E04F 19/06

(56) References Cited

U.S. PATENT DOCUMENTS

| | | | | |
|---|---|---|---|---|
| 2002/0124504 | A1 | 9/2002 | Maylon | |
| 2003/0051422 | A1 | 3/2003 | Maziarz | |
| 2004/0020143 | A1 | 2/2004 | Webb | |
| 2004/0216414 | A1 | 11/2004 | Dickinson | 52/506.01 |
| 2005/0204653 | A1 | 9/2005 | Matthews | E02D 31/02 |
| 2006/0005472 | A1 | 1/2006 | Miller | E06B 7/18 |
| 2006/0150553 | A1 | 7/2006 | Reyes | E04F 13/06 |
| 2006/0277854 | A1* | 12/2006 | Egan | E04B 1/80 52/302.3 |
| 2007/0062137 | A1 | 3/2007 | Maylon | 52/367 |
| 2008/0104918 | A1* | 5/2008 | Gleeson | E04B 1/762 52/489.1 |
| 2008/0263971 | A1* | 10/2008 | Maziarz | E04B 1/66 52/204.1 |
| 2009/0183453 | A1 | 7/2009 | Koessler | 52/302.3 |
| 2010/0257799 | A1 | 10/2010 | Johnson | E04F 13/0864 |
| 2011/0277394 | A1 | 11/2011 | Chich et al. | 52/95 |
| 2012/0174495 | A1 | 7/2012 | Nolan | E04F 19/045 |
| 2012/0324814 | A1* | 12/2012 | Amend | E04B 1/7645 52/302.1 |
| 2013/0205696 | A1* | 8/2013 | Little | E04F 13/073 52/255 |
| 2014/0245676 | A1 | 9/2014 | Maziarz | E06B 1/62 |
| 2016/0069071 | A1* | 3/2016 | Remmele | E04C 2/34 52/232 |
| 2016/0186481 | A1 | 6/2016 | Maziarz | E06B 1/02 |
| 2017/0130462 | A1 | 5/2017 | Maziarz | E04F 13/06 |
| 2017/0254091 | A1* | 9/2017 | Friel | E04B 1/765 |
| 2017/0342709 | A1* | 11/2017 | Dahlin | E04B 1/64 |
| 2018/0112414 | A1* | 4/2018 | Maziarz | E06B 1/62 |
| 2019/0161960 | A1 | 5/2019 | Baltz, Jr. et al. | E04B 1/7076 |
| 2019/0186147 | A1 | 6/2019 | Baltz, Jr. et al. | E04D 13/158 |
| 2019/0194954 | A1 | 6/2019 | Baltz, Jr. et al. | E04F 19/04 |
| 2020/0240153 | A1* | 7/2020 | Maziarz | E04F 19/061 |

FOREIGN PATENT DOCUMENTS

| | | | |
|---|---|---|---|
| DE | 3503395 | 8/1986 | E04B 1/68 |
| FR | 2307091 | 11/1976 | |
| FR | 2412236 | 7/1979 | |
| FR | 2507227 | 12/1982 | E04B 1/68 |
| SU | 1705521 | 1/1992 | |

OTHER PUBLICATIONS

U.S. Appl. No. 16/137,340, filed Sep. 20, 2018, Maziarz.
Notice of Allowance issued in U.S. Appl. No. 11/981,421, dated Sep. 8, 2010 (6 pgs).
Notice of Allowance issued in U.S. Appl. No. 12/152,046, dated Feb. 12, 2014 (16 pgs).
Notice of Allowance issued in U.S. Appl. No. 12/931,079, dated Aug. 21, 2013 (11 pgs).
Notice of Allowance issued in U.S. Appl. No. 14/275,757, dated Jan. 29, 2016 (5 pgs).
Notice of Allowance issued in U.S. Appl. No. 15/865,952, dated May 30, 2019 (4 pgs).
Notice of Allowance issued in U.S. Appl. No. 15/791,246, dated Oct. 25, 2019 (15 pgs).
Notice of Allowance issued in U.S. Appl. No. 16/137,340, dated Jan. 14, 2020 (14 pgs).
Office Action issued in U.S. Appl. No. 09/952,920, dated Jan. 22, 2003 (12 pgs).
Office Action issued in U.S. Appl. No. 09/952,920, dated Jan. 26, 2005 (9 pgs).
Office Action issued in U.S. Appl. No. 09/952,920, dated Jun. 22, 2004 (6 pgs).
Office Action issued in U.S. Appl. No. 09/952,920, dated Oct. 22, 2003 (7 pgs).
Office Action issued in U.S. Appl. No. 11/259,499, dated Aug. 28, 2008 (9 pgs).
Office Action issued in U.S. Appl. No. 11/259,499, dated Oct. 23, 2007 (6 pgs).
Office Action issued in U.S. Appl. No. 11/259,499, dated Sep. 7, 2006 (9 pgs).
Office Action issued in U.S. Appl. No. 11/981,421, dated Aug. 5, 2009 (6 pgs).
Office Action issued in U.S. Appl. No. 12/152,046, dated Feb. 28, 2011 (7 pgs).
Office Action issued in U.S. Appl. No. 12/152,046, dated Nov. 30, 2011 (6 pgs).
Office Action issued in U.S. Appl. No. 12/152,046, dated Nov. 2, 2012 (28 pgs).
Office Action issued in U.S. Appl. No. 12/931,079, dated Oct. 15, 2012 (29 pgs).
Office Action issued in U.S. Appl. No. 12/931,079, dated Sep. 23, 2011 (11 pgs).
Office Action issued in U.S. Appl. No. 14/275,721, dated Jul. 13, 2015 (8 pgs).
Office Action issued in U.S. Appl. No. 14/275,721, dated Sep. 29, 2014 (9 pgs).
Office Action issued in U.S. Appl. No. 14/275,757, dated Jul. 14, 2015 (8 pgs).
Office Action issued in U.S. Appl. No. 14/275,757, dated Sep. 29, 2014 (9 pgs).
Office Action issued in U.S. Appl. No. 15/062,876, dated Oct. 19, 2016 (17 pgs).
Office Action issued in U.S. Appl. No. 15/791,246, dated Apr. 16, 2018 (6 pgs).
Office Action issued in U.S. Appl. No. 15/791,246, dated Dec. 12, 2018 (20 pages).
Office Action issued in U.S. Appl. No. 15/791,246, dated Jul. 26, 2018 (26 pgs).
Office Action issued in U.S. Appl. No. 15/791,246, dated Jul. 3, 2019 (27 pgs).
Office Action issued in U.S. Appl. No. 15/865,952, dated Mar. 1, 2019 (8 pgs).
Office Action issued in U.S. Appl. No. 15/865,952, dated Oct. 11, 2018 (10 pgs).
Office Action issued in U.S. Appl. No. 16/137,340, dated Aug. 6, 2019 (35 pgs).
Office Action issued in U.S. Appl. No. 14/869,524, undated, 11 pages.
U.S. Appl. No. 14/869,524 (unpublished).
U.S. Appl. No. 16/848,622, filed Apr. 14, 2020, Maziarz.
Office Action issued in U.S. Appl. No. 16/848,622, dated Mar. 12, 2021, 22 pgs.
Notice of Allowance issued in Canadian application No. 2,983,532, 1 pg.
Notice of Allowance issued in U.S. Appl. No. 16/848,622, dated Apr. 21, 2021, 17 pages.

* cited by examiner

BEAD STOP FOR A WALL HAVING IN INTERIOR CEMENT BOARD LAYER

CROSS REFERENCE TO RELATED APPLICATION

This application claims benefit of U.S. Provisional Application Ser. No. 62/947,885 filed Dec. 13, 2019, the entire disclosure of which is incorporated herein by reference.

FIELD OF THE DISCLOSURE

The present disclosure is generally related to stop beads and more particularly is related to stop beads for a wall having an interior cement board layer.

BACKGROUND OF THE DISCLOSURE

In the construction and building industry, stucco, plaster, or similar cement-based materials are commonly used as a wall finishing product to new and existing building. Stucco is generally composed of aggregates, a binder, and water. Once mixed, it is in a wet state and is applied to the exterior Sheathing of the building walls. After a period of time, it hardens to a very dense solid where it effectively acts as a durable exterior wall finish for the building.

The specific application of stucco can vary depending on a number of factors, such as the climate and geography of the building, the weather while the stucco is being applied, the finished decorative look of the stucco wall, and others. In virtually all installations, however, the installer first prepares the exterior sheathing of the building. This exterior sheathing layer is commonly composed of plywood, fiberboard, oriented strand board (OSB), or plank lumber which is affixed to the studs of the wall. The installer may then install various stucco accessories, such as weep screeds, expansion and control joints, corner-aids, and architectural reveals. The installer then affixes a wire mesh material, such as wire lath, expanded-metal lath, wove-wire lath, or welded-wire lath, against the exterior sheathing using appropriate fasteners. This wire mesh material provides a structural interfacing material to which the stucco can adhere, such that the stucco is properly retained against the exterior sheathing. The wire mesh material also adds strength to the stucco.

The installation of the stucco generally includes three different layers: first the scratch coat, then the brown coat, and then the finish coat. The scratch coat may consist of plastic cement and sand, or other materials, Which is installed against the wire mesh material with a trowel. The scratch coat is generally ⅜ inch to ½ inch thick and envelopes the wire mesh material. Prior to the scratch coat drying, the installer scores the surface with a trowel, scarifier, or similar tool to provide ¼ inch to ⅜ inch deep grooves, which provide an area for the next coat of stucco to adhere to and create a solid bond. The scratch coat must then be left to cure or dry for at least 24 hours, preferably 3-5 days, prior to the next coat.

Once the scratch coat has dried for at least 24 hours, the brown coat can be applied. The brown coat or leveling coat commonly consists of sand, cement, and lime. It is applied to a general thickness of ⅜ inch and is finished to have a leveled, smooth, even exterior surface. This smooth exterior surface is what the finish coat will eventually be applied to. However, before application of the finish coat, the brown coat must dry or cure for a minimum of 7-10 days to allow for shrinkage and/or cracking to occur. After waiting 70-10 days, the installer then returns to the job site to fill in any cracks that have appeared. It is well understood in the industry that waiting 7-10 days for the brown coat to cure is essential to ensuring the stucco wall finish is structurally sound and free from visual defects and imperfections. If the brown coat is not left to cure for 7-10 days and the finish coat is applied prematurely, the stucco wall will be substandard and likely to fail.

After waiting a minimum of 8 days from the initial application of the scratch coat, the final layer of the stucco wall finish may be applied. This final layer is the finish coat, which may include an acrylic finish or a color coat. The finish coat is generally a very thin layer, e.g., ⅛ inch or less, and is applied to the exterior of the cured brown coat. The finish coat may have a decorative finish to it as well as a specific color.

There are a number of complications with installing stucco. First, thetime required from start to finish is lengthy and installers must schedule various jobs at various times to ensure that proper cure times are maintained, all while balancing workflow. For example, a stucco installer may have 6 or more stucco projects occurring simultaneously, with each in different stages of application or curing. Another complication caused by the required cure times is that it makes the wall susceptible to damage from the weather. Especially with the brown coat, if rain or other precipitation occurs during the 7-10-day curing period, the moisture will damage the brown coat. If the damage is severe enough, the brown coat will need to be scraped off and reapplied, which is a very laborious and time-consuming process. Recent innovative techniques in stucco application have been developed to help alleviate these complications, but these new methods require new wall accessories and components.

Thus, a heretofore unaddressed need exists in the industry to address the aforementioned deficiencies and inadequacies.

SUMMARY OF THE DISCLOSURE

Embodiments of the present disclosure provide a system for terminating a wall. Briefly described, in architecture, one embodiment of the system, among others, can be implemented as follows. A stop bead apparatus is affixed to exterior sheathing of a wall. The stop bead apparatus has: a substantially planar base panel; a stop bead wall extending in a substantially perpendicular angle from the base panel along a first edge of the base panel; a flexible spacing member extending from a first side of the stop bead wall to a jamb; and a front wall connected to the stop bead wall, the front wall extending a second side of the stop bead wall, wherein the second side is substantially opposite the first side, wherein a gap is formed between opposing faces of the base panel and the front wall. A rigid cement board is positioned within the gap, wherein cement forming the rigid cement board is cured prior to insertion into the gap. A finish layer is applied to an exterior surface of the rigid cement board.

The present disclosure can also be viewed as providing methods of constructing a termination point in a wall. In this regard, one embodiment of such a method, among others, can be broadly summarized by the following steps: attaching a stop bead apparatus to exterior sheathing of the wall at a terminating location of the wall; inserting an edge of a rigid, cured cement board into a gap formed between a base panel and a front wall of the stop bead apparatus; securing the cement board to the exterior sheathing, wherein at least a portion of the base panel of the stop bead apparatus is positioned between the exterior sheathing and the cement board;

and applying a finish layer to an exterior surface of the cement board.

The present disclosure can also be viewed as providing a stop head apparatus for use with a stucco wall. Briefly described, in architecture, one embodiment of the apparatus among others, can be implemented as follows. The stop bead apparatus has a substantially planar base panel. A stop bead wall extends in a substantially perpendicular angle from the base panel along a first edge of the base panel. A flexible spacing member extends from a first side of the stop bead wall. A front wall is connected to the stop bead wall, the front wall extending a second side of the stop bead wall, wherein the second side is substantially opposite the first side, wherein a gap is formed between opposing faces of the base panel and the front wall. A rigid cement board is removably insertable into the gap.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1A:
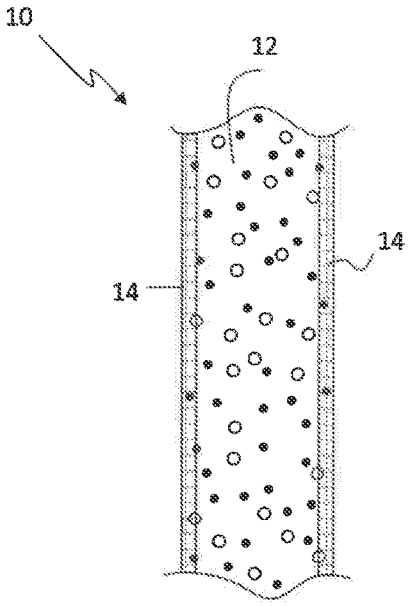
FIG. 1A is a cross-sectional illustration of a rigid cement board, in accordance with a first exemplary embodiment of the present disclosure.
Figure 1B:
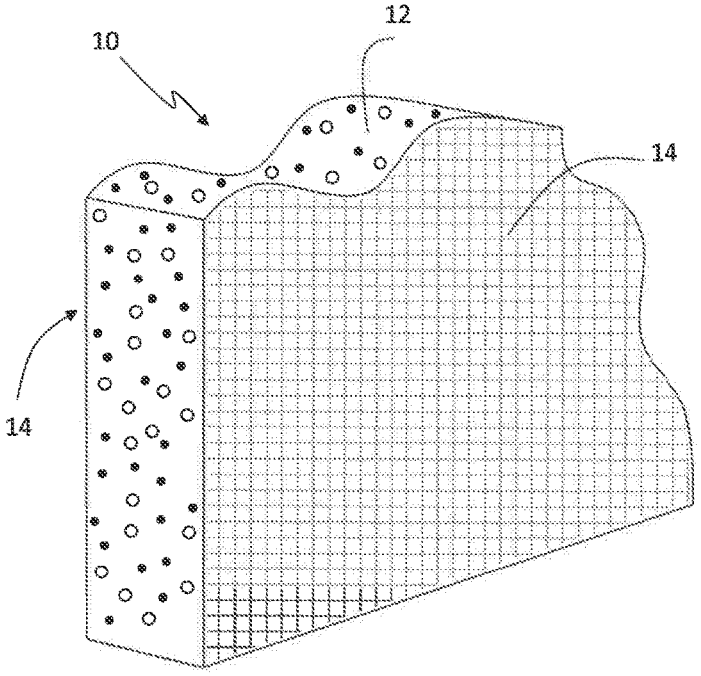
FIG. 1B is a plan view illustration of a rigid cement board, in accordance with the first exemplary embodiment of the present disclosure.

To improve upon the shortcomings of the prior art, as described in the Background, the subject disclosure provides a system for terminating a wall. The wall is constructed with a rigid cement board as an interior layer, replacing scratch layer and effectively replacing the brown layer. FIG. 1A is a cross-sectional illustration of a rigid cement board, in accordance with a first exemplary embodiment of the present disclosure. FIG. 1B is a plan view illustration of a rigid cement board, in accordance with the first exemplary embodiment of the present disclosure. With reference to FIGS. 1A-1B, a cement board 10 is depicted. Cement board 10 is a rigid, cured building material composed of aggregated Portland cement 12 with a glass-fiber mesh 14 on the surfaces. During manufacture of the cement board 10, viscous, uncured cement is mixed with aggregate and other materials, such as fillers, stabilizers, etc., and the mixture is placed in a mold. The mold has glass-fiber mesh 14 or other mesh reinforcements which line the outer surfaces of the cement board 10. The aggregate cement 12 is infused into the mesh 14, as shown in FIG. 1A, such that the aggregate cement 12 and mesh 14 effectively become a unitary structure. The aggregate cement 12 is then cured for a period of time until it is rigid. The cement board 10 may then be cut to shape, which is commonly 3-foot by 5-foot planar sheets which are 0.25 inch thick, 0.5 inch thick, 0.75 inch thick, or another thickness.

To lessen the time it takes to finish the exterior wall of a structure, these rigid cement boards 10 may be used in place of the scratch layer and/or brown layer on conventional stucco or plaster walls. Specifically, the installer may install the cement board 10 directly on the sheathing of the wall, or over another material placed on the sheathing, such as a vapor or moisture barrier. The cement board 10 may be secured with fasteners, such as screws, which affix the cement board to the sheathing. Once the wall is appropriately covered, the installer may then apply a finish coat to the wall, including filling any cracks between the adjacent edges of the cement board 10. Because the cement hoard 10 is already cured and rigid, the wall does not need to be given time to cure and shrink, as is required with conventional stucco and piaster walls. Thus, it is possible for an installer to effectively install the entirety of a stucco or plaster wall in one single day using cement board 10 versus the 8-15 days required with conventional stucco or plaster walls. This time savings allows the installer to be more efficient and also minimizes the risk of damage to an unfinished wall due to rain or moisture exposure.

Figure 2:
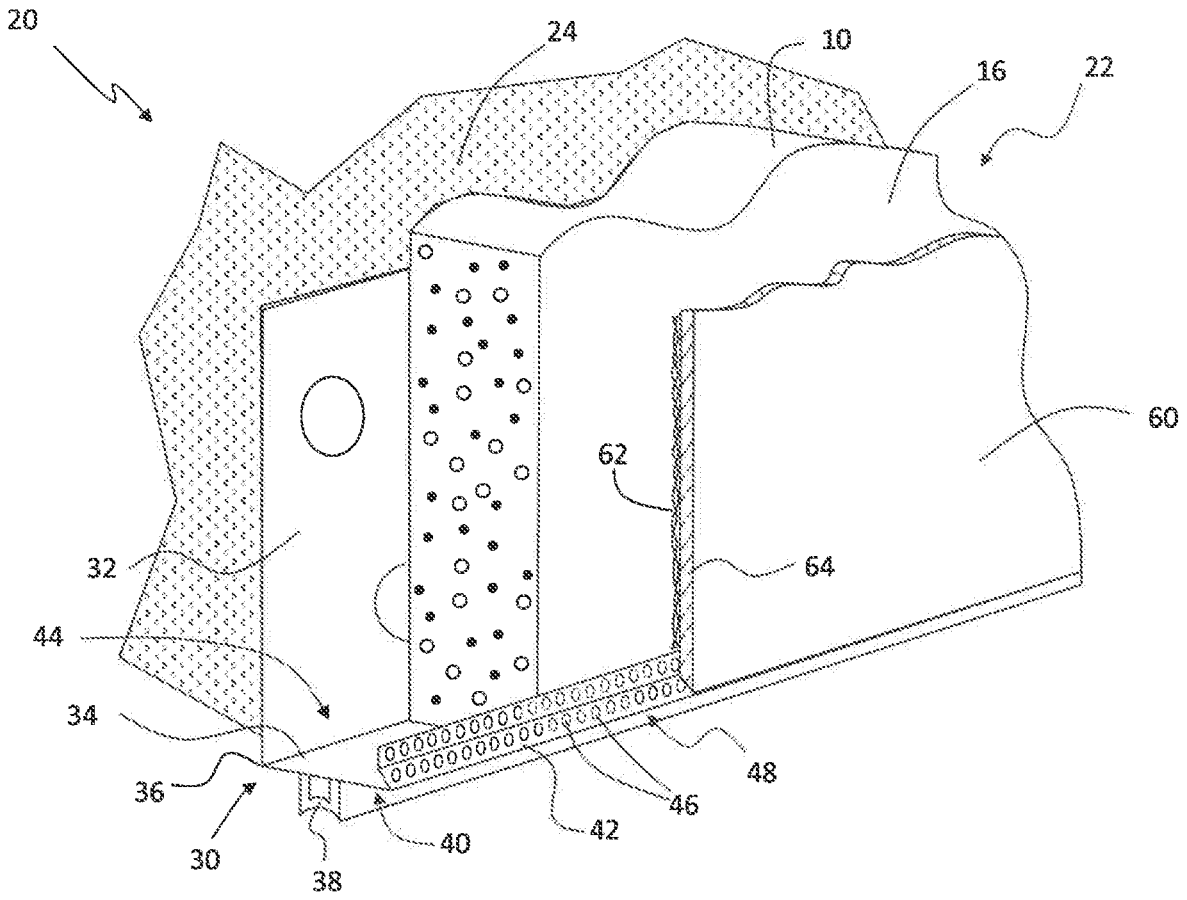
FIG. 2 is a cut-away plan view illustration of a system for terminating a wall using a stop bead apparatus, in accordance with the first exemplary embodiment of the present disclosure.

The subject invention is directed to a system 20 for terminating a wall 22 which uses rigid, cured cement board 10 as an interior layer of the wall's 22 exterior surface. FIG. 2 is a cut-away plan view illustration of a system 20 for terminating a wall using a stop bead apparatus, in accordance with the first exemplary embodiment of the present disclosure. With reference to FIG. 2, a stop bead apparatus 30 affixed to exterior sheathing 24 of a wall 22. The stop bead apparatus 30 has a substantially planar base panel 32. The base panel 32 may be designed to fit against sheathing 24 of the wall 22, with one side of the base panel 32 abutting the sheathing 24. As is known in the industry, the sheathing 24 may include a variety of sheathing materials, such as plywood, OSB, particle board, wood planks, or another sheathing material. The stop bead apparatus 30 may be positioned on the sheathing 24 in locations of the wall 22 which abut termination points of the wall 22, commonly jambs of doors or windows or at other termination locations. In these locations, the stop bead apparatus 30 provides for a termination joint or junction within the wall to the jamb or other structure. The stop bead apparatus 30, and any components thereof, may be constructed from extrusion, molding or other manufacturing technique using plastic, vinyl, metal, metal compounds, fiber glass, or other materials.

The stop bead apparatus 30 includes a stop bead wall 34 extending in a substantially perpendicular angle from the base panel 32 along a first edge 36 of the base panel 32. The stop bead wall 34 is positioned such that it substantially extends out of the planar face of the wall 22, whereby it has an interior side which can contact the cement board 10 and an exterior side that faces towards the jamb of the door or window. A flexible spacing member 38 extends from a first side 40 (exterior side) of the stop bead wall 34 to a jamb (FIGS. 3B, 4B, 5B, 6B, and 7-8). This spacing member 38 may be resilient and flexible, such that the stop bead apparatus 30 can be positioned with the pointed tip or tips of the spacing member 38 against the jamb. During contractions and expansions of the building materials due to weather or temperature changes, the spacing member 38 maintains a tight bond with the jamb, thereby preventing moisture, air, insects, or other materials from gaining access to the interior of the structure through the wall 22 at this location.

The stop bead apparatus 30 also has a front wall 42 which is connected to the stop bead wall 34. The front wall 42 generally extending in a direction substantially opposite the first side of the stop bead wall 34, e.g., such that it extends away from the spacing member 38. The front wall 42 may extend a predetermined distance from the stop bead wall 34 to form a gap 44 between opposing faces of the base panel 32 and the front wall 42. Depending on the design of the system 20, the size of the front wall 42 and gap 44 may vary.

As is shown in FIG. 2, the rigid cement board 10 can be positioned within the gap 44. In this position, one planar face of the cement board 10 may be positioned abutting the base panel 32 and/or the sheathing 24 behind the base panel 32, while the other planar face of the cement board 10, i.e., the exterior face 16, faces outwards away from the wall. Since the cement used to form the rigid cement board 10 is cured at a factory or other venue prior to insertion into the gap 44, the rigid cement hoard 10 can be easily inserted into the gap 44 by an installer on-site. Accordingly, the installer may cover the sheathing 24 of the wall 22 with a plurality of cement board 10, thereby constructing a base or interior layer of the exterior surface of the wall 22. Once the rigid cement board 10 is appropriately positioned on the sheathing 24, it may be fastened to the sheathing 24 with a screw, nail, or other fastener (not shown). This fastener structurally retains the cement board 10 to the sheathing 24. After the cement board 10 is installed on a wall 22 surface, the installer may then apply a finish layer 60 to the exterior face 16 of the rigid cement board 10.

The finish layer 60 may include a variety of different materials and/or techniques, depending on the design of the wall. For example, it may be common for the installer to fill in any gaps between the edges of the cement boards 10 and then apply the finish layer. This may include first applying a wire mesh 62 which is fastened to the cement board 10. To the wire mesh 62, a finish coat 64 of stucco and/or plaster may then be applied, where the stucco and/or plaster material impregnates the wire mesh 62, which effectively holds it to the cement board 10. In other examples of the finish layer 60, the finish layer 60 may include other materials or techniques. For example, the installer may still install a brown coat, but the thickness of the brown coat may be substantially less than that of conventional stucco or piaster walls, such that the drying or curing time may lie far less than the conventional time of 7-10 days. The finish layer 60 may also include other materials beyond plaster or stucco, such as thin veneered stone, or other natural or artificial stone materials which can be applied to the wall as the finish layer 60.

Regardless of how the finish layer 60 is applied, the edge of the finish layer 60 may be interfaced with at least a portion of the front wall 42 of the stop bead apparatus 30, thereby allowing the installer to terminate the finish layer 60. The front wall 42 may include one or a plurality of features 46, such as holes, grooves, channels, or similar structural features, which catch the stucco or plaster material used in the finish layer 60, thereby securing, holding or catching the edge of the finish layer 60. This may prevent the edge of the finish layer 60 from falling off the wall 22. Additionally, the installer may install the finish layer 60 up to an exterior point 48 of the front wall 42, which effectively acts as a finish edge for the finish layer 60. This exterior point 48 which can be used to create a finish edge may have a variety of different shapes and dimensions, such as depicted relative to FIGS. 3A-6B.

Figure 3A:
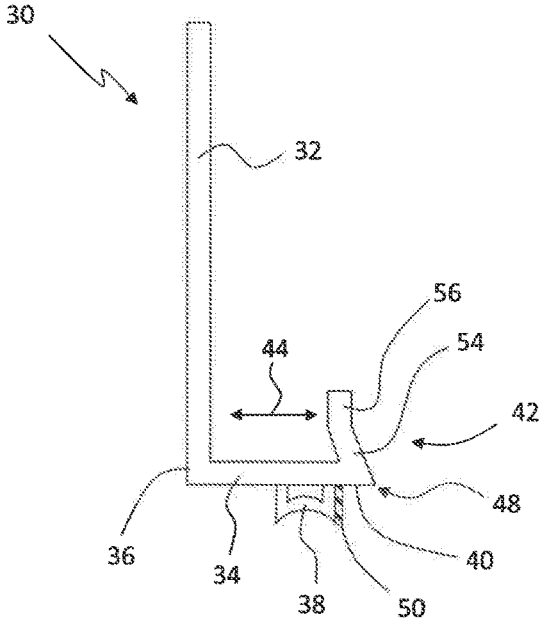
FIGS. 3A-3B are cross-sectional side view illustrations of a system for terminating a wall using a stop bead apparatus, in accordance with the first exemplary embodiment of the present disclosure.
Figure 3B:
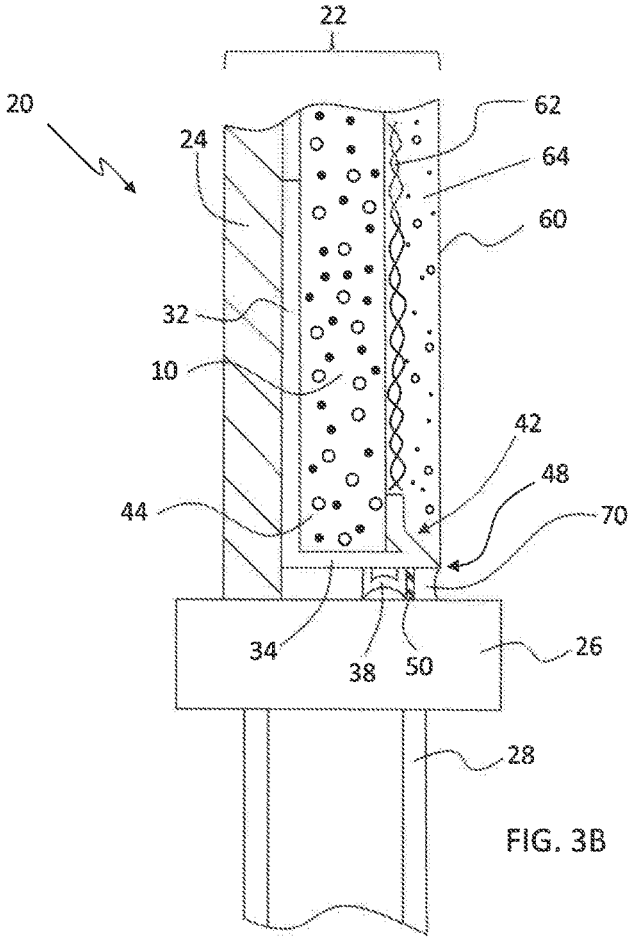

FIGS. 3A-6B are cross-sectional side view illustrations of a system for terminating a wall using a stop bead apparatus, in accordance with the first exemplary embodiment of the present disclosure. In particular, FIGS. 3A-6B depict various types of stop bead apparatuses 30 which can be used with a wall. Referring first to FIGS. 3A-3B, the stop bead apparatus 30 is depicted both alone (FIG. 3A) and in a finished wall (FIG. 3). The base panel 32 is positioned against the sheathing 24 with the stop bead wall 34 and the spacing member 38 positioned proximate to the jamb 26 of a window 28, such that the spacing member 38 contacts the edge of the jamb 26. A cement board 10 is positioned in the gap 44 formed between the base panel 32 and the front wall 42. On the exterior of the cement, board 10 is the finish layer 60, which in this example, includes a wire mesh 62 and a finish coat 64 of stucco or plaster. The finish layer 60 terminates along the front wall 42, where the pointed exterior edge 48 is used to form the finish edge in the finish layer 60. As shown, the exterior edge 48 may be the outermost structure of the stop bead apparatus 30, which allows the installer to achieve a clean termination of the stucco or plaster wall. A quantity of caulking 70 may be positioned between the stop bead wall 34 and the jamb 26 and exterior of the spacing member 38, which allows for a seamless interface from the jam 26 to the wall 22. A bond-breaking tape 50 may be used between the caulking 70 and the spacing member 38, which allows for easy removal of the caulking 70.

As can be seen in FIGS. 3A-3B, the front wall 42 of the stop bead apparatus 30 includes first and second connected wall portions, 52, 54 which have different angular positions. The first wall portion 52 extends from the stop bead wall 34 at an acute angle relative to the stop bead wall 34, i.e., as measured between the surfaces of the stop bead wall 34 and first wall portion 52 forming the gap 44. The second wall portion 54 is connected to the first wall portion 52 and is positioned substantially parallel to the base panel 32. As can be seen, the combination of the first and second wall portions 52, 54 allows for the front wall 42 to have a pointed exterior edge 48 in the first wall portion 52, while allowing for adequate space for placing the finish layer 60 over part of the front wall 42, namely, the second wall portion 54 and part of the first wall portion 52. The front wall 42 may include one or a plurality of features, such as holes, grooves, channels, or similar structural features, as shown in FIG. 2, which catch the stucco or piaster material used in the finish layer 60, thereby securing, holding or catching the edge of the finish layer 60.

While the dimensions of the structure may vary, in one example the base panel is 1.75 inches and the front wall is approximately 0.75 inches in length with the first wall portion 52 being approximately 0.25 inches and the second wall portion 54 being 0.5 inches. The angular position of the first wall portion 52 may extend back towards the base panel 32 approximately 0.125 inches. The gap 44 may be approximately 0.5 inches, such that it is sized to receive a cement board 10 having a 0.5 inch thickness. For cement board 10 having other thicknesses, the gap 44 may be sized differently. Also, the space of the gap 44 may be slightly smaller than the thickness of the intended cement board 10, such that the front wall 42 is slightly biased outwards upon insertion of the cement board 10, and compresses back towards the cement board 10 to create a tight joint.

Figure 4A:
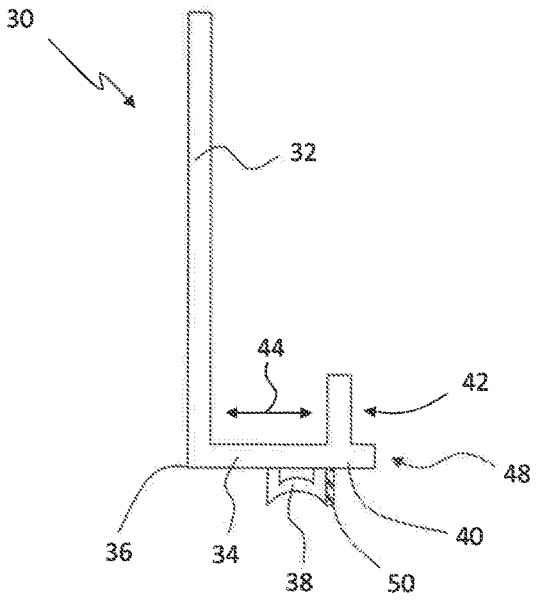
FIGS. 4A-4B are cross-sectional side view illustrations of a system for terminating a wall using a stop bead apparatus, in accordance with the first exemplary embodiment of the present disclosure.
Figure 4B:
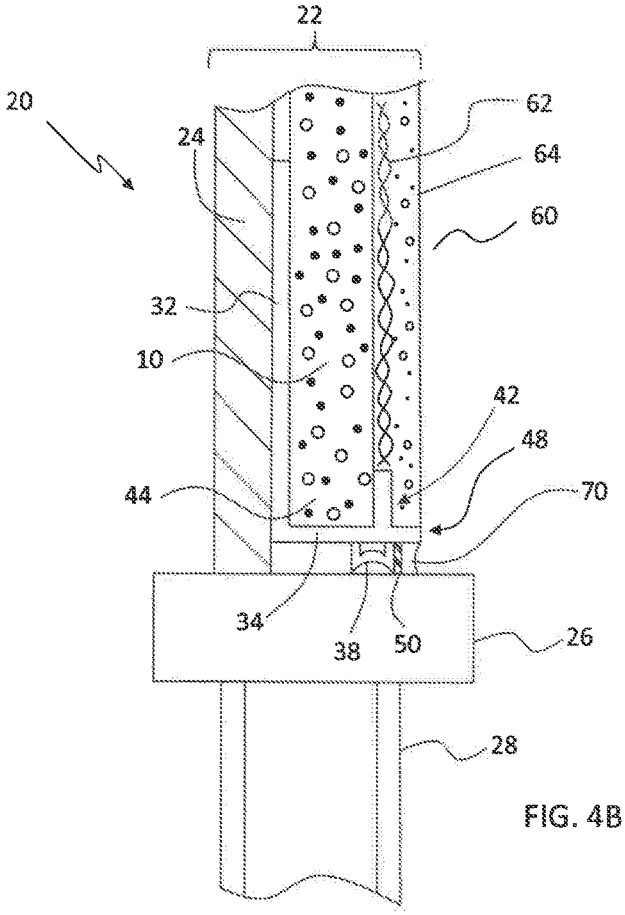

FIGS. 4A-4B illustrate a variation of the front wall 42 design of the stop bead apparatus 30, which apart, from the front wall 42, contains all of the features and structures discussed relative to FIGS. 3A-3B. For brevity in disclosure, reference is made to the description relative to FIGS. 3A-3B for these common features. Regarding the front wall 42, as can be seen in FIGS. 4A-4B, the front wall 42 extends from the stop bead wall 34 in a substantially perpendicular angle to the stop bead wall 34. The front wall 42 includes a single, unitary wall portion which is set back from a terminating edge of the stop bead wall 34. This terminating edge of the stop bead wall 34 forms exterior edge 4$ of the stop bead apparatus 30, while the set-back position of the front wall 42 allows for adequate space for the finish layer 60 to be applied. The front wall 42 may include one or a plurality of features, such as holes, grooves, channels, or similar structural features, as shown in FIG. 2, which catch the stucco or plaster material used in the finish layer 60, thereby securing, holding or catching the edge of the finish layer 60. While the dimensions may vary, the front wall may be set back approximately 0.125 to 0.25 inches while the height of the front wall may be approximately 0.75 inches.

Figure 5A:
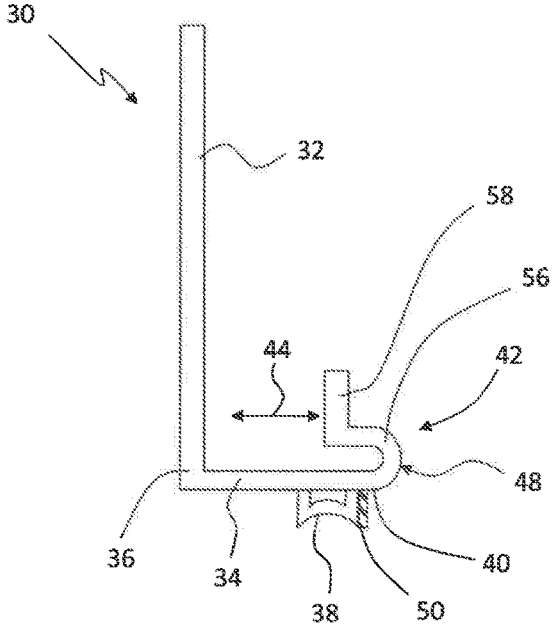
FIGS. 5A-5B are cross-sectional side view illustrations of a system for terminating a wall using a stop bead apparatus, in accordance with the first exemplary embodiment of the present disclosure.
Figure 5B:
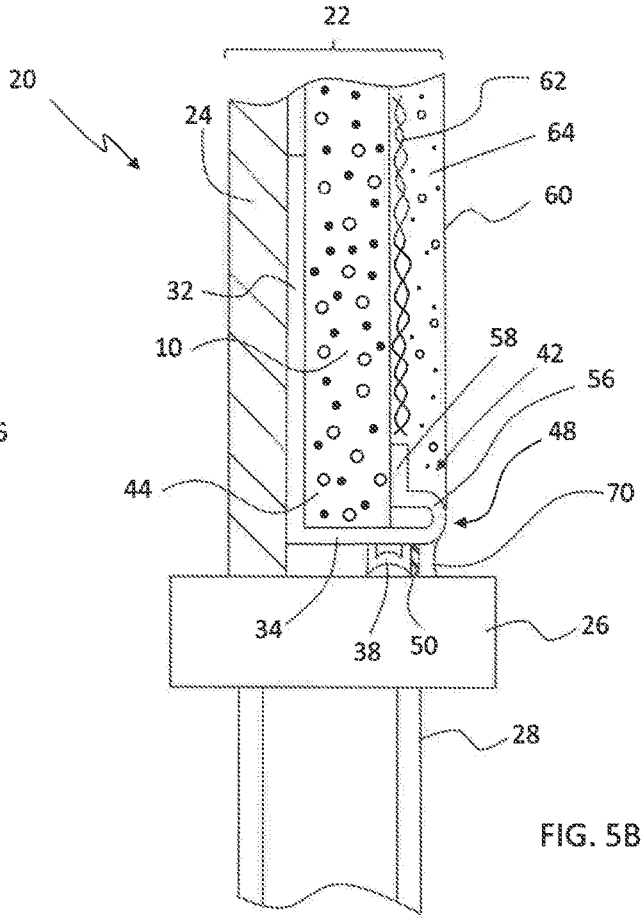

FIGS. 5A-5B illustrate another variation of the front wall 42 design of the stop bead apparatus 30, which apart from the front wall 42, contains all of the features and structures discussed relative to FIGS. 3A-3B. For brevity in disclosure, reference is made to the description relative to FIGS. 3A-3B for these common features. Regarding the front wall 42, as can be seen in FIGS. 5A-5B, the front wall 42 has a curved portion 56 extending from the stop bead wall 34 and extending back in a direction towards the base panel 32 in a U-shape. The curved portion 56 may be integrally formed with the end of the stop bead wall 34 and is formed at an outermost location of the stop bead apparatus 30, such that the exterior-most point of the curved portion 56 forms the exterior edge 48. The return or turned-back part of the curved portion 56 may be connected to a second wall portion 58 which is substantially linear and extends in a direction parallel to the base panel 32. The set-back location of the second wall portion 58 allows for adequate space for the finish layer 60 to be applied. The front wall 42 may include one or a plurality of features, such as holes, grooves, channels, or similar structural features, as shown in FIG. 2, which catch the stucco or plaster material used in the finish layer 60, thereby securing, holding or catching the edge of the finish layer 60. While the dimensions may vary, the front wall may be set back approximately 0.125 to 0.25 inches while the overall height of the front wall may be approximately 0.75 inches.

Figure 6A:
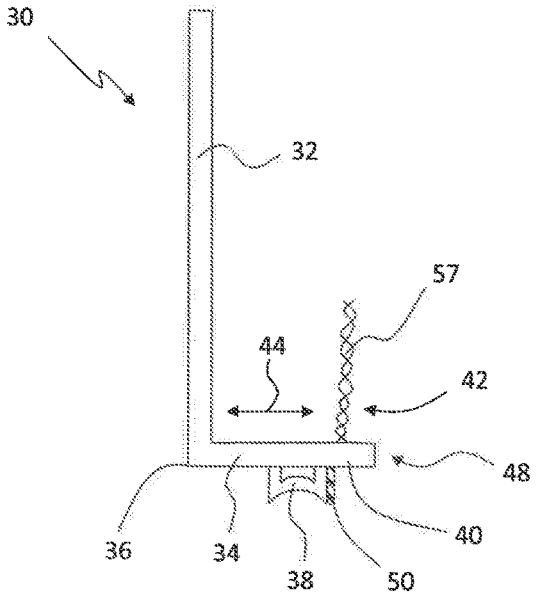
FIGS. 6A-6B are cross-sectional side view illustrations of a system for terminating a wall using a stop bead apparatus, in accordance with the first exemplary embodiment of the present disclosure.
Figure 6B:
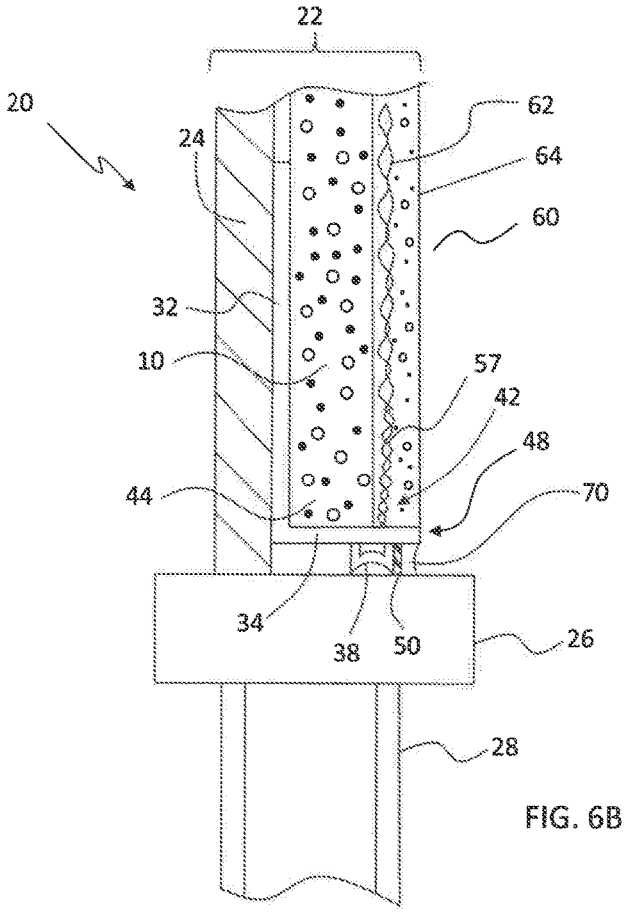

FIGS. 6A-6B illustrate another variation of the front wall 42 design of the stop bead apparatus 30, which apart from the front wall 42, contains all of the features and structures discussed relative to FIGS. 3A-3B. For brevity in disclosure, reference is made to the description relative to FIGS. 3A-3B for these common features. Regarding the front wall 42, as can be seen in FIGS. 6A-6B, the front wall 42 is formed as a mesh structure 57 which can interface and/or contact the wire mesh 62 used in the finish layer 60. The mesh structure 57 may be made from any type of material, such as plastics, vinyl, metal, galvanized metals, fiber glass or others, and may have any type of mesh design. In one example, the mesh structure 57 is manufactured separately from the stop bead wall 34 and incorporated into the stop bead wall 34 during a molding or extrusion process. In use, the mesh structure 57 may be positioned facially abutting the wire mesh 62 of the finish layer, or the two may be positioned overlapping, or the two may be separated by a distance. The set-back location of the mesh structure 57 may allow for adequate space for the finish layer 60 to be applied. The front 42 may include one or a plurality of features, such as holes, grooves, channels, or similar structural features, as shown in FIG. 2, which catch the stucco or plaster material used in the finish layer 60, thereby securing, holding or catching the edge of the finish layer 60. While the dimensions may vary, the mesh structure 57 of the front wall 42 may be set back approximately 0.125 to 0.25 inches while the overall height of the front wall 42 may be approximately 0.75 inches.

Figure 7:
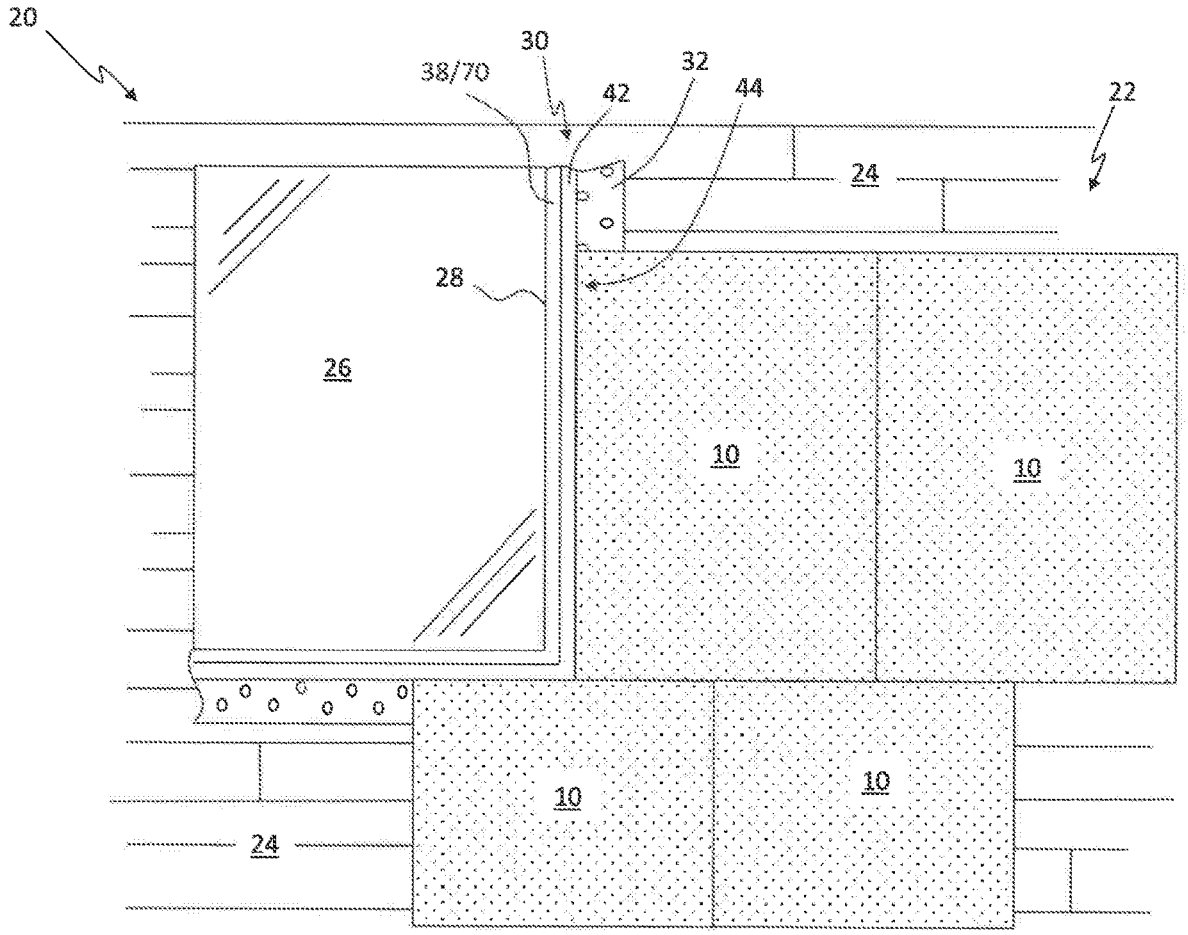
FIG. 7 is a cut-away front view illustration of a wall with a system for terminating the wall using a stop bead apparatus, in accordance with the first exemplary embodiment of the present disclosure.
Figure 8:
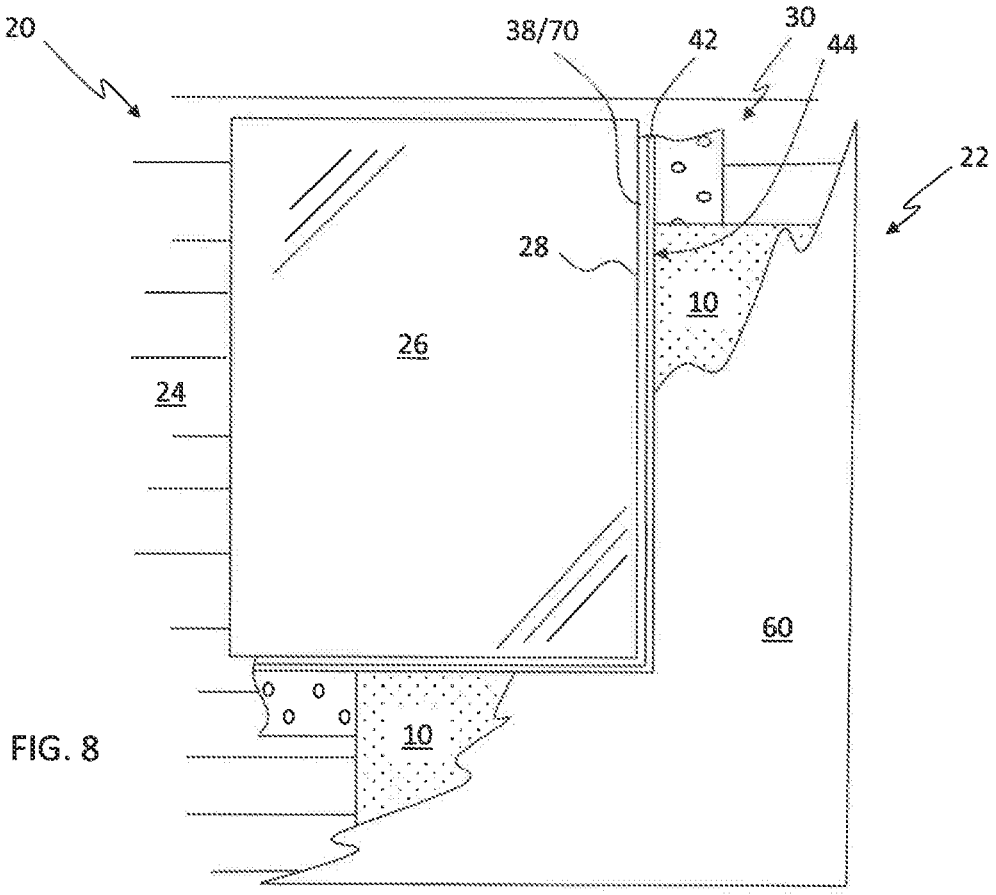
FIG. 8 is a detailed cut-away front view illustration of a wall with a system for terminating the wall using a stop bead apparatus of FIG. 7, in accordance with the first exemplary embodiment of the present disclosure.

FIG. 7 is a cut-away front view illustration of a wall with a system for terminating the wall using a stop bead apparatus, in accordance with the first exemplary embodiment of the present disclosure. FIG. 8 is a detailed cut-away front view illustration of a wall with a system for terminating the wall using a stop bead apparatus of FIG. 7, in accordance with the first exemplary embodiment of the present disclosure. Referring to FIGS. 7-8, an example of the overall wall 22 construction can be seen. Here, a window 28 with a jamb 26 is constructed in a wall 22. The wall 22 has sheathing 24 which is positioned over the framework of the wall 22. To terminate the wall 22 at the jamb 26, the stop bead apparatus 30 may be used, where the stop bead apparatus 30 is attached to the sheathing 24 around the jamb 26, such that the spacing member 38 and caulked joint 70 abut the jamb 26. A plurality of rigid cement boards 10 may be positioned on the wall 22, where the cement boards 10 abutting the jamb 26 are positioned with their edges in the gap 44 of the stop bead apparatus 30, as shown in FIG. 7, where the edges of the cement board 10 are covered by the front wall 42 of the stop bead apparatus 30. Once the cement boards 10 are appropriately affixed to the wall 22, the finish layer 60 may be installed over them, as shown in FIG. 8.

Figure 9:
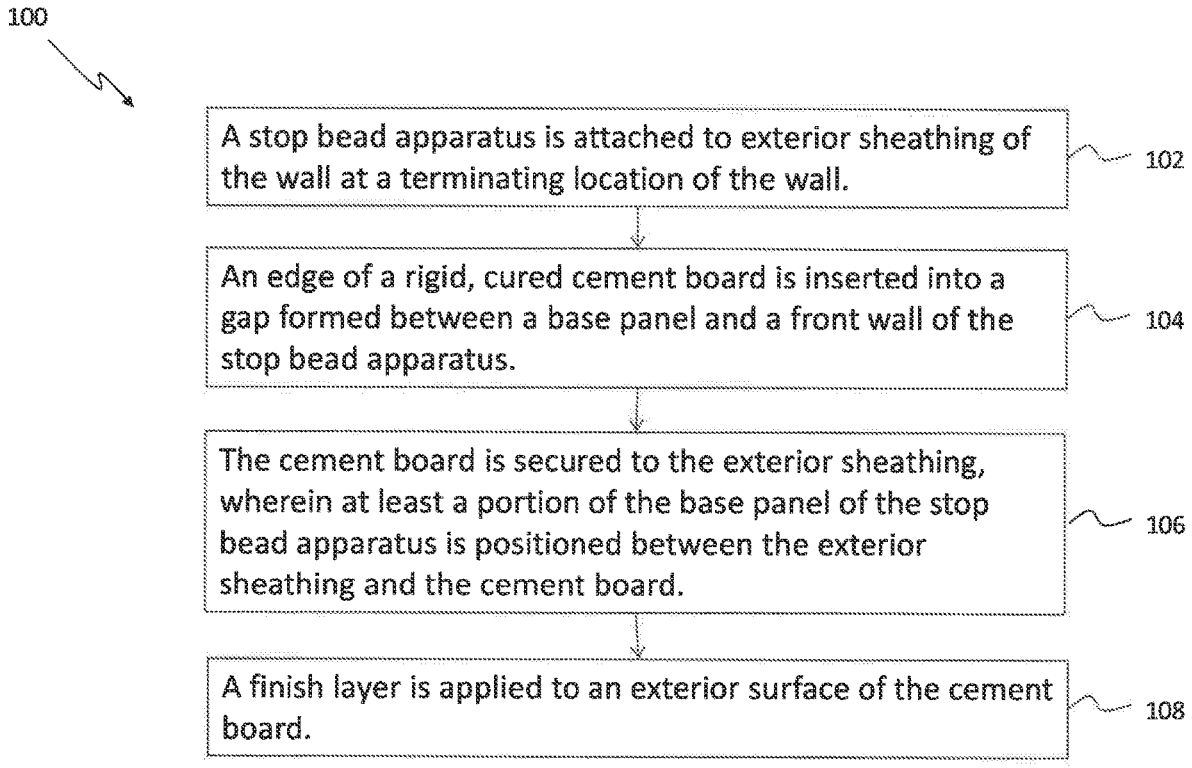
FIG. 9 is a flowchart illustrating a method for constructing a termination point in a wall, in accordance with the first exemplary embodiment of the disclosure.

FIG. 9 is a flowchart 100 illustrating a method for constructing a termination point in a wall 22, in accordance with the first exemplary embodiment of the disclosure. It should be noted that any process descriptions or blocks in flow charts should be understood as representing modules, segments, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 102, a stop bead apparatus is attached to exterior sheathing of the wall at a terminating location of the wall. An edge of a rigid, cured cement board is inserted into a gap formed between a base panel and a front wall of the stop bead apparatus (block 104). The cement board is secured to the exterior sheathing, wherein at least a portion of the base panel of the stop bead apparatus is positioned between the exterior sheathing and the cement board (block 106). A finish layer is applied to an exterior surface of the cement board (block 108), As discussed previously, this method may save considerable time to installers of stucco or plaster walls by using cement boards which are cured and rigid, as opposed to scratch layers applied on-site. The stop bead apparatus may further enhance the time savings by allowing installers to easily and efficiently terminate the wall at a jamb or other structure, all while ensuring that the wall termination is durable and high-quality, it is noted that the method may include any number of additional steps, variations, or functions beyond those illustrated in FIG. 9, where the additional steps, variations, or functions may include any disclosed relative to FIGS. 1-8 herein, all of which serve as a portion of the disclosure of the method of FIG. 9.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A stop bead apparatus for use with terminating a stucco or thin veneered stone wall at a location against a jamb of a door or window, the stop bead apparatus comprising:

a jamb of a door or window;

a substantially planar base panel attachable to exterior sheathing of a wall proximate to the jamb of the door or window;

a stop bead wall extending in a substantially perpendicular angle from the base panel along a first edge of the base panel, the stop bead wall having a first side facing towards the jamb and a second side facing away from the jamb, the stop bead wall being free from holes or openings;

a flexible spacing member extending from the first side of the stop bead wall, wherein the flexible spacing member is compressed against the jamb thereby maintaining a tight bond against the jamb;

a front wall connected to the stop bead wall, the front wall extending in a direction substantially opposite the first side, wherein a gap is formed between opposing faces of the base panel and the front wall;

wherein the stop bead apparatus is free from weep holes; and a rigid cement board secured to the exterior sheathing of the wall at a location on the wall without a space between the cement board and the exterior sheathing, the rigid cement board having at least an edge portion thereof removably insertable into the gap, wherein the edge portion of the rigid cement board has a terminating face which faces the stop bead wall of the stop bead apparatus, and wherein an entirety of the terminating face of the rigid cement board within the gap is in direct contact with the second side of the stop bead wall, whereby the terminating face of the rigid cement board is in a position against the stop bead wall, and whereby the flexible spacing member maintains the tight bond against the jamb.

2. The stop bead apparatus of claim 1, wherein the front wall comprises at least first and second connected wall portions, wherein the first wall portion extends from the stop bead wall at an acute angle relative thereto, and wherein the second wall portion is positioned substantially parallel to the base panel, wherein the rigid cement board is contacted by at least the second wall portion when the rigid cement board is inserted into the gap.

3. The stop bead apparatus of claim 1, wherein the front wall extends from the stop bead wall in a substantially perpendicular angle, wherein the front wall is set back from a terminating edge of the stop bead wall.

4. The stop bead apparatus of claim 1, wherein the front wall comprises a curved portion extending from the stop bead wall, wherein the curved portion is positioned at an outermost location of the stop bead apparatus.

5. A system for terminating a wall at a location against a jamb of a door or window, the system comprising:

a stop bead apparatus affixed to exterior sheathing of a wall, wherein the stop bead apparatus is attached to the exterior sheathing of the wall proximate to a jamb of a door or window, the stop bead apparatus having:

a substantially planar base panel;

a stop bead wall extending in a substantially perpendicular angle from the base panel along a first edge of the base panel, the stop bead wall having a first side facing towards the jamb and a second side facing away from the jamb, the stop bead wall being free from holes or openings;

a flexible spacing member extending from the first side of the stop bead wall to the jamb, wherein the flexible spacing member is compressed against the jamb thereby maintaining a tight bond against the jamb; and a front wall connected to the stop bead wall, the front wall extending in a direction substantially opposite the first side, wherein a gap is formed between opposing faces of the base panel and the front wall;

wherein the stop bead apparatus is free from weep holes;

a rigid cement board secured to the exterior sheathing of the wall at a location on the wall without a space between the cement board and the exterior sheathing, the rigid cement board having at least an edge portion thereof positioned within the gap, wherein the edge portion of the rigid cement board has a terminating face which faces the stop bead wall of the stop bead apparatus, and wherein an entirety of the terminating face of the rigid cement board within the gap is in direct contact with the second side of the stop bead wall, whereby the terminating face of the rigid cement board is in a position against the stop bead wall, and whereby the flexible spacing member maintains the tight bond against the jamb, and wherein cement forming the rigid cement board is cured prior to insertion into the gap; and a finish layer applied to an exterior surface of the rigid cement board.

6. The system of claim 5, further comprising a caulked joint between the stop bead apparatus and the jamb.

7. The system of claim 6, further comprising a bond-breaking tape positioned between an exterior surface of the spacing member and the caulked joint between the stop bead apparatus and the jamb.

8. The system of claim 5, wherein a terminating edge of the finish layer is secured to at least a portion of the front wall of the stop bead apparatus.

9. The system of claim 5, wherein the front wall of the stop bead apparatus comprises at least first and second connected wall portions, wherein the first wall portion extends from the stop bead wall at an acute angle relative thereto, and wherein the second wall portion is positioned substantially parallel to the base panel.

10. The system of claim 5, wherein the front wall of the stop bead apparatus extends from the stop bead wall in a substantially perpendicular angle, wherein the front wall is set back from a terminating edge of the stop bead wall.

11. The system of claim 5, wherein the front wall of the stop bead apparatus comprises a curved portion extending from the stop bead wall, wherein the curved portion is positioned at an outermost location of the stop bead apparatus.

12. A method for constructing a termination point in a wall at a location against a jamb of a door or window, the method comprising the steps of:

attaching a stop bead apparatus to exterior sheathing of the wall at a terminating location of the wall proximate to the jamb of a door or window, the stop bead having a flexible spacing member mounted to a stop bead wall, the stop bead wall being free from holes or openings and being positioned substantially parallel to the jamb, wherein the flexible spacing member is compressed against the jamb thereby maintaining a tight bond against the jamb, wherein the stop bead apparatus is free from weep holes;

inserting a terminating edge of a rigid, cured cement board into a gap formed between a base panel and a front wall of the stop bead apparatus, wherein the terminating edge of the rigid cement board has a terminating face which faces the stop bead wall of the stop bead apparatus, and wherein an entirety of the terminating face of the rigid cement board within the gap is in direct contact with the stop bead wall, whereby the terminating face of the rigid cement board is in a position biased against the stop bead wall, and whereby the flexible spacing member maintains the tight bond against the jamb;

securing the cement board to the exterior sheathing at a location on the wall without a space between the cement board and the exterior sheathing, wherein at least a portion of the base panel of the stop bead apparatus is positioned between the exterior sheathing and the cement board; and applying a finish layer to an exterior surface of the cement board.

13. The method of claim 12, further comprising the step of caulking a joint between the stop bead apparatus and the jamb.

14. The method of claim 13, further comprising a bond-breaking tape positioned between an exterior surface of the spacing member and the caulking within the joint between the stop bead apparatus and the jamb.

15. The method of claim 12, wherein applying the finish layer to the exterior surface of the cement board further comprises securing a terminating edge of the finish layer to at least a portion of the front wall of the stop bead apparatus.

16. The method of claim 12, wherein the front wall of the stop bead apparatus comprises at least first and second connected wall portions, wherein the first wall portion extends from the stop bead wall at an acute angle relative thereto, and wherein the second wall portion is positioned substantially parallel to the base panel.

17. The method of claim 12, wherein the front wall of the stop bead apparatus extends from the stop bead wall in a substantially perpendicular angle, wherein the front wall is set back from a terminating edge of the stop bead wall.

18. The method of claim 12, wherein the front wall of the stop bead apparatus comprises a curved portion extending from the stop bead wall, wherein the curved portion is positioned at an outermost location of the stop bead apparatus.

* * * * *